US006918252B2

(12) United States Patent
Zimron et al.

(10) Patent No.: US 6,918,252 B2
(45) Date of Patent: Jul. 19, 2005

(54) METHOD OF AND APPARATUS FOR COOLING A SEAL FOR MACHINERY

(75) Inventors: Ohad Zimron, Gan Yavne (IL); Nadav Amir, Rehovot (IL); Meir Rigal, Doar Na Avtah (IL)

(73) Assignee: Ormat Technologies Inc., Sparks, NV (US)

( * ) Notice: Subject to any disclaimer, the term of this patent is extended or adjusted under 35 U.S.C. 154(b) by 19 days.

(21) Appl. No.: 10/083,666

(22) Filed: Feb. 27, 2002

(65) Prior Publication Data

US 2003/0159444 A1 Aug. 28, 2003

(51) Int. Cl.[7] ..... E01D 25/08

(52) U.S. Cl. ..... 60/646; 60/656; 60/657

(58) Field of Search ..... 60/646, 656, 657; 277/3, 22, 81 R, 59.65; 415/111, 112, 175, 176

(56) References Cited

U.S. PATENT DOCUMENTS

| | | | | |
|---|---|---|---|---|
| 4,486,147 A | * | 12/1984 | Byrne et al. | 416/213 R |
| 4,786,238 A | * | 11/1988 | Glaser et al. | 417/53 |
| 4,969,796 A | * | 11/1990 | Wescott et al. | 415/110 |
| 5,156,523 A | * | 10/1992 | Maier | 415/175 |
| 5,217,350 A | * | 6/1993 | Kimura et al. | 415/175 |
| 5,743,094 A | | 4/1998 | Zimron et al. | |
| 6,296,441 B1 | * | 10/2001 | Gozdawa | 415/180 |

* cited by examiner

*Primary Examiner*—Hoang Nguyen
(74) *Attorney, Agent, or Firm*—Nath & Associates PLLC; Gary M. Nath; Jerald L. Meyer

(57) ABSTRACT

A method is provided for cooling a seal located in a wall of a chamber and through which a movable shaft passes, the seal being heated by hot pressurized vapor that leaks through the seal into the chamber and internal friction. The method comprises the steps of: providing a chamber in which the seal is located and into which the hot pressurized vapor leaks; injecting cool liquid into the chamber in which the seal is located; and cooling and condensing the hot pressurized vapor in the chamber thus cooling the seal.

12 Claims, 4 Drawing Sheets

METHOD OF AND APPARATUS FOR COOLING A SEAL FOR MACHINERY

TECHNICAL FIELD

This invention relates to a method of and apparatus for cooling a seal for machinery including rotating machinery, and more particularly, for cooling the seal of a turbine shaft.

BACKGROUND OF INVENTION

Rotating machinery, such as turbine in which wheels mounted on a shaft, require rotary seals in the region where the shaft passes through the pressure chamber that contains the turbine wheels. Such seals inhibit leakage of working fluid from the pressure chamber into the seal operating environment and then into the atmosphere. In addition, seals are also required in other machinery.

Seals for rotating machinery usually comprise a labyrinth seal followed by a mechanical seal. Labyrinth seals serve to restrict the rate of flow of working fluid and reduce its pressure toward atmospheric pressure, but not to prevent or contain the flow. Typically, labyrinth seals have many compartments positioned very close to the surface of the shaft for presenting to the working fluid in the pressure chamber a torturous path that serves to reduce pressure and inhibit, but not halt leakage. A mechanical seal, on the other hand, serves to contain the working fluid. The extent to which containment is achieved depends on the design of the seal and the nature of the working fluid involved.

When the working fluid is steam, some escape of the working fluid can be tolerated. Nevertheless, a shaft seal for the steam turbine is a critical item. It is even more critical when the working fluid is a hydrocarbon, such as pentane or isopentane, and the turbine operates as part of an organic Rankine cycle power plant. In such case, the mechanical seals must preclude to as great an extent possible the loss of working fluid to the atmosphere. Reliable operation of the mechanical seals for turbines, as well as for other types of equipment where the temperature of the mechanical seal is elevated, requires the seals to operate under optimum working conditions of pressure, temperature, vibration, etc. These working conditions have a significant impact on seal leakage rates and seal life expectancy, for example. By extending seal life, turbine life and hence reliability is extended.

Seal life is adversely affected by high operating pressure and temperature that tends to distort seal faces. High operating pressure also increases wear rate, heat generated at the seal faces which further distorts seal faces and results in increased leakage. In addition, the high pressure increases power consumption for the turbine sealing system.

In a related system, described in U.S. Pat. No. 5,743,094, the disclosure of which is incorporated by reference, a method of and apparatus for cooling a seal for machinery is disclosed. In the system and apparatus disclosed in the '094 patent, a cooled surroundings is produced in the seal operating environment in which a mixture of cooled liquid droplets and vapor is present. This mixture is supplied to the condenser of the power plant unit for condensing the vapor present in the mixture. Such a system, thus requires a condenser for condensing the cooled mixture present in the seal-operating environment, High operating temperatures of the seal components adversely affect seal life. High seal component temperatures increase wear on the seal faces, and also increase the likelihood that the barrier fluid when used will boil. It is therefore an object of the present invention to provide a new and improved method of and apparatus for cooling the seals for equipment.

BRIEF DESCRIPTION OF THE INVENTION

In accordance with the present invention, a method is provided for cooling a seal located in a wall of a chamber and through which a movable shaft passes, the seal being heated by hot pressurized vapor that leaks through the seal into the chamber and internal friction. The method comprises the steps of: (a) providing a chamber in which the seal is located and into which the hot pressurized vapor leaks; (b) injecting cool liquid into the chamber in which the seal is located; and (c) cooling and condensing the hot vapor in the chamber thus cooling and reducing the pressure in the chamber surrounding the seal. Preferably, the method includes the step of providing a pressure chamber for containing the hot pressurized vapor within which a turbine wheel is mounted on the shaft, and vapor leaks past a labyrinth mounted on the shaft between the turbine wheel and the seal. Also, preferably, the method additionally comprises the step of adding the liquid to the chamber in which the seal is located by injecting the liquid into the chamber near a disc mounted in the chamber, the disc being mounted on, and rotatable with, the shaft. Furthermore, the method, preferably, in addition can be used in a power plant that includes a vaporizer for vaporizing a working fluid, a turbine mounted on the shaft for expanding the working fluid, a condenser for condensing expanded working fluid, and a cycle pump for returning condensate from the condenser to the vaporizer, and comprises the step of supplying the liquid exiting the chamber to a line exiting the condenser and connected to the cycle pump. Moreover, the method furthermore, preferably includes comprising the step of adding the liquid to the chamber in which the seal is located from the output of the cycle pump.

Furthermore, according to the present invention, apparatus is also provided for cooling a seal located in a wall of a chamber and through which a movable shaft passes, the seal being heated by hot pressurized vapor that leaks through the seal into the chamber in which the seal is located and internal friction. The apparatus comprises a chamber in which the seal is located and into which leaks the hot pressurized vapor and means for injecting liquid into the chamber such that the hot pressurized vapor is cooled and condenses in the chamber, thus cooling and reducing the pressure in the chamber surrounding the seal. Preferably, the apparatus also includes a turbine wheel mounted on the shaft in the pressure chamber containing hot pressurized, vaporized working fluid, wherein the shaft passes through a labyrinth seal mounted on the shaft. Also, preferably, the apparatus additionally comprises means for adding the liquid to the chamber in which the seal is located near a disc in the chamber mounted on the shaft and rotatable therewith. Furthermore, the apparatus, preferably, in addition can be used in a power plant that includes a vaporizer for vaporizing a working fluid, a turbine mounted on the shaft for expanding the working fluid, a condenser for condensing expanded working fluid, a cycle pump for returning condensate from the condenser to the vaporizer and means for supplying the liquid exiting the chamber to a line exiting the condenser and connected to the cycle pump. Moreover, the apparatus further preferably includes a supply means for supplying the liquid from the output of the cycle pump is the means or injecting liquid into the chamber in which the seal is located.

BRIEF DESCRIPTION OF THE DRAWINGS

Embodiments of the present invention are described by way of example with reference to the accompanying drawings wherein.

Like reference numerals and designations in the various drawings refer to like elements.

DETAILED DESCRIPTION

Figure 1:
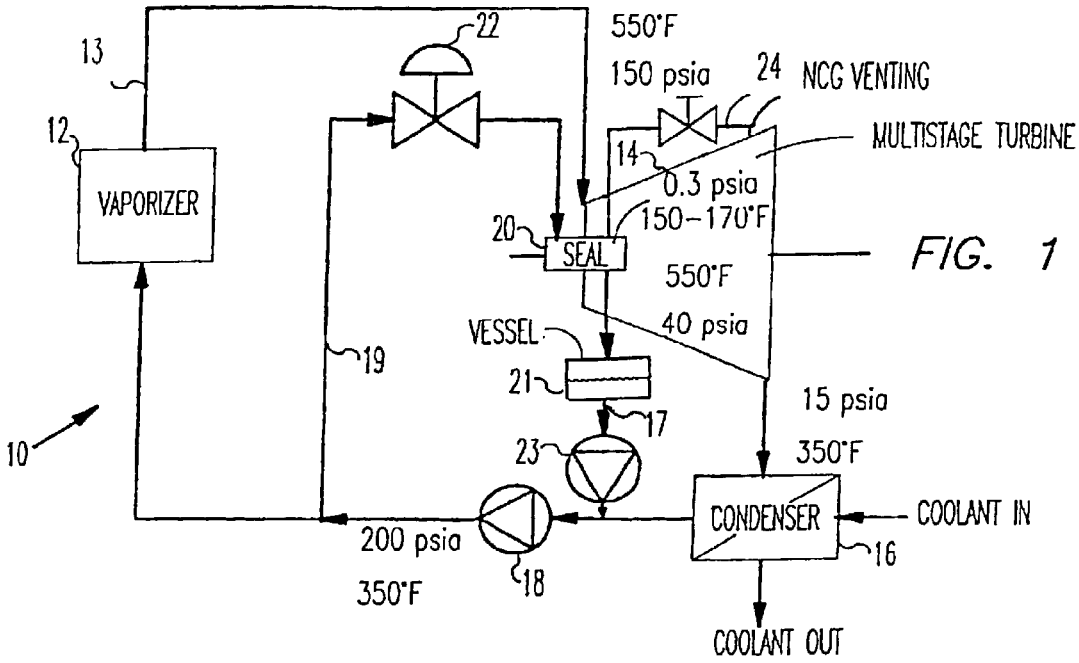
FIG. 1 is a black diagram of a power plant into which the present invention is incorporated.

Referring now to the drawings, reference numeral 10 of FIG. 1 designates a power plant into which the present invention is incorporated. Power plant 10 includes vaporizer 12 for vaporizing a working fluid, such as water, or a heat transfer working fluid (e.g., Dowtherm J, or Therminol LT, etc.), and producing vaporized working fluid that is supplied to turbine 14. Usually, turbine 14 will be a multistage turbine, but the principle of the invention is applicable to a single stage turbine as well.

Vaporized working fluid supplied to turbine 14 expands in the turbine and produces work that is converted into electricity by a generator (not shown). The cooled, expanded working fluid is exhausted into indirect condenser 16 wherein the vaporized working fluid is condensed by the extraction of heat in the coolant supplied to the condenser. The condensate, at a relatively low pressure and temperature, as compared to the conditions at the outlet of the vaporizer, is pressurized by cycle pump 18 and returned to the vaporizer, completing the working fluid cycle.

Seal 20, which is the seal between the atmosphere and the pressure chamber (not shown) containing the stages of the turbine, is contained in a seal chamber that is isolated from the pressure chamber by a labyrinth seal (not shown) and from the atmosphere by the mechanical seal (not shown). This mechanical seal has to be cooled. As shown, cool liquid working fluid is supplied to the seal chamber by cycle pump 18 through valve 22 in connection 19, and the chamber is connected to vessel 21 by connection 17. Furthermore, seal chamber 20 is connected via line 24 and a restricting orifice to a low-pressure region, e.g. the turbine exhaust limiting the seal chamber pressure and for venting non-condensable gases (NCG's) from the seal chamber in case NCG's accumulate in the seal chamber.

When power plant 10 is an organic Rankine cycle power plant, operating with a heat transfer working fluid like Therminol LT, for example, as the working fluid, the conditions in the condenser typically will be about 350° F. at about 15 psia, and the conditions at the outlet of the cycle pump typically will be about 350° F. at about 200 psia.

The actual conditions in the seal chamber can be controlled by valve 22 by regulating the flow of cool liquid working fluid to the seal chamber. Typically, working fluid vapor leaking through the labyrinth seal into the seal is at about 40 psia and about 550° F. Under these conditions, the cooler liquid, which is supplied via valve 22, will interact with the leakage vapor thus cooling and condensing the same by directly transferring heat to the liquid in the seal chamber thus preventing the heating of the seal chamber and reducing the pressure therein. This has the beneficial effect of reducing the temperature of the seal itself without directly cooling the seal with the liquid working fluid. In addition, NCG venting/pressure limiting line 24 vents NCG's (if present) from seal chamber 20 and controls their accumulation therein. By connecting line 24 to a low-pressure region e.g. the turbine exhaust, the pressure in seal chamber 20 can be limited.

Figure 2:
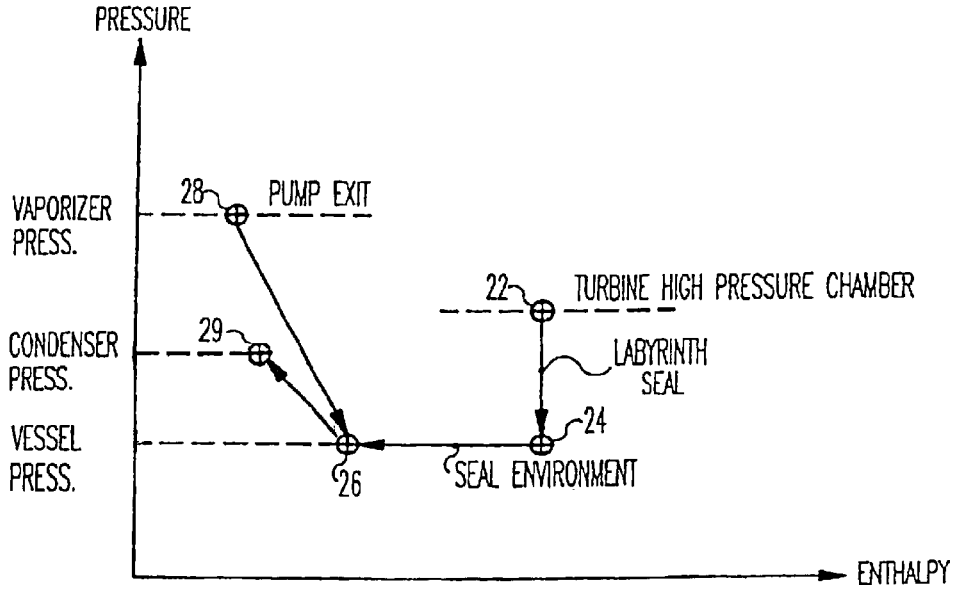
FIG. 2 is a pressure enthalpy diagram showing the sources of fluid that contribute to heating and cooling the seal.

The operation described above is illustrated by FIG. 2. As indicated, leakage of vapors from the pressure chamber of the turbine whose conditions are indicated by point 22 to the seal chamber whose conditions are indicated by point 24 result in a pressure reduction inside the seal chamber which is held at the conditions of vessel 21 indicated by point 26. The condition of liquid working fluid furnished by cycle pump 18 to the seal chamber, indicated by point 28, changes from point 28 to point 26. Condensate produced in the seal chamber is supplied to vessel 21 and pump 23 supplies the condensate from vessel 21 to the exit of condenser 16 indicated by point 29. Based on this schematic showing, the heat balance is as follows:

(1) $m_{liq} \times h_{liq} + m_{vapor} \times h_{vapor} = m_{cond} \times h_{cond}$ where $m_{liq}$=cold liquid flow rate $h_{liq}$=enthalpy of cold liquid $m_{vapor}$=vapor leakage flow rate $h_{vapor}$=vapor enthalpy $m_{cond} = m_{liq} + m_{vapor}$ $h_{cond}$=enthalpy of condensate at vessel pressure and required condensate temperature.

Figures 3, 4:
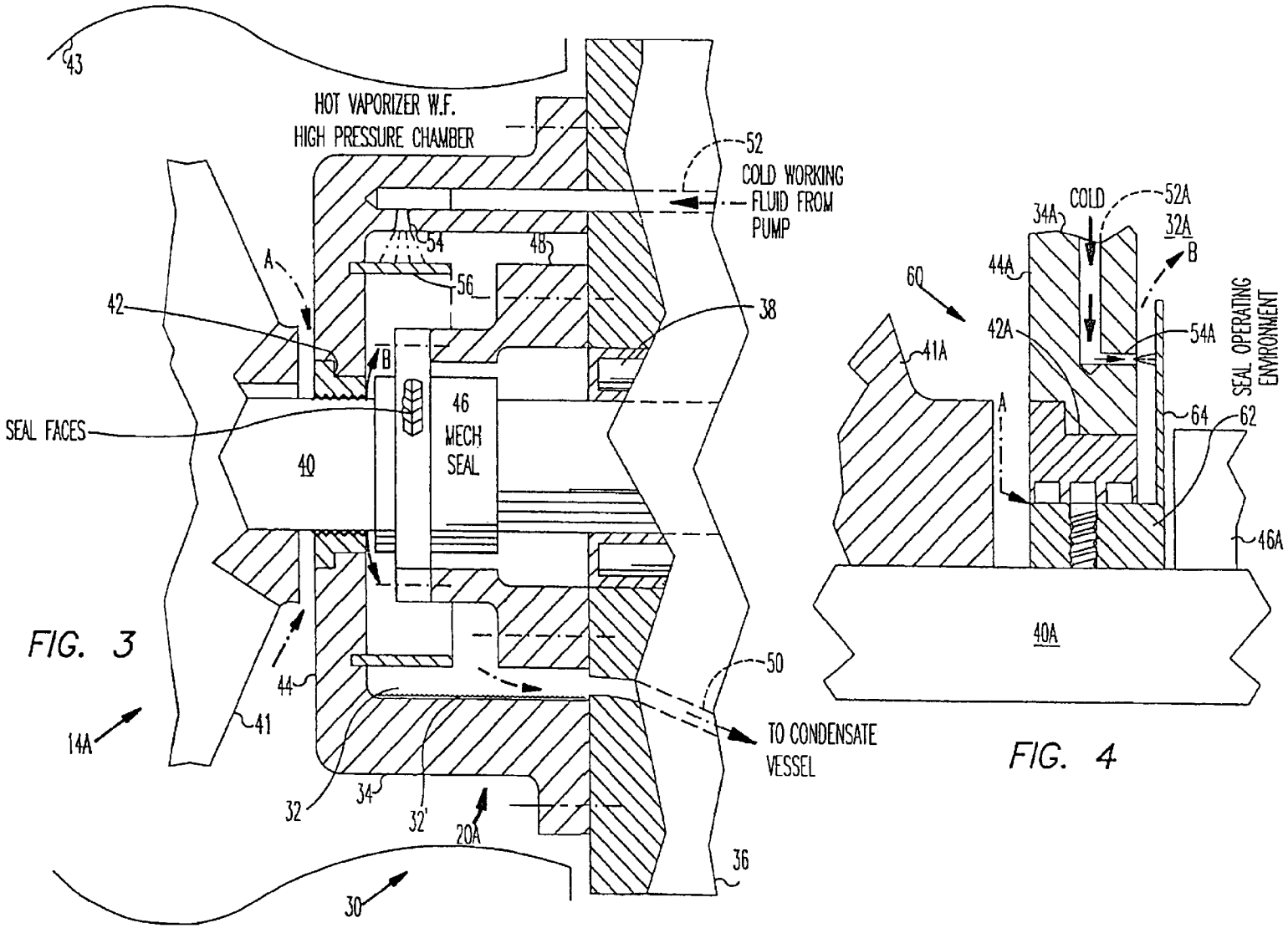
FIG. 3 is a side view, partially in section, showing one embodiment of the present invention.
FIG. 4 is a side view of a modification of the embodiment shown in FIG. 3.

Specific details of one embodiment of the invention is shown in FIG. 3 to which reference is now made where reference numeral 30 designates apparatus according to the present invention incorporated into turbine 14A. Apparatus 30 includes seal chamber 20A in the form of seal chamber 32, defined by housing 34 rigidly attached to stationary mounting 36 containing bearing 38 on which shaft 40 of turbine wheel 41 is mounted by a suitable key arrangement. A housing that defines a high-pressure housing or chamber 43 containing hot pressurized working fluid vapors contains wheel 41.

Labyrinth seal 42 mounted in face 44 of housing 34 provides the initial resistance to leakage of the hot vaporized working fluid in chamber 43 into seal chamber 32. Such leakage is indicated by chain arrows A and B. Normally, this leakage would heat mechanical seal 46 having sealing faces carried by, and rotating with, shaft 40. This face is in contact with a stationary sealing face carried by hub 48 rigidly attached to housing 36. Normally, both stationary and rotating or dynamic seal faces are cooled by a barrier fluid, e.g., pressurized mineral oil pressurized to about 15 psi above the maximum seal chamber pressure (e.g., about 30 to 40 psia in the present embodiment).

Seal chamber 32 is connected by connection 50 to vessel 21. This chamber is also connected via connection 52 to the output of cycle pump 18 as shown in FIG. 1. Pressurized liquid working fluid at the temperature substantially of the condenser is supplied via connection 52 to spray head nozzles 54 that open to the interior of seal chamber 32, and relatively cold liquid working fluid is sprayed onto cylindrical shield 56 further converting the liquid into fine droplets inside seal chamber 32. The fine droplets interact with hot vapor leakage B thereby cooling this hot vapor by means of direct contact heat transfer of heat in the vapor to liquid contained in the droplets and condensation of the hot vapor takes place thus producing a liquid including the working fluid condensate that is vented and drained by connection 17 into vessel 21. As a result, the temperature of mechanical seal 46 can be maintained at a desired temperature by regulating the amount of liquid supplied to connection 52. Shield 56 shields mechanical seal 46 from direct contact with cool liquid from the condenser and thus projects the seal against thermal shock.

The preferred embodiment of the present invention is described with reference to FIG. 4, considered at present the best mode for carrying out the present invention, and is designated by reference numeral 60. This embodiment includes turbine wheel 41A rigidly attached to shaft 40A that passes though housing 34A, and mechanical seal 46A inside seal chamber 32A. Instead of labyrinth seal 42 engaging shaft 40 directly, as in the embodiment of FIG. 3, seal 42A engages hub 62 rigidly attached to the shaft. However, the labyrinth seal may engage the shaft if preferred. Hub 62 includes flange 64 that lies inside seal chamber 32A close to face 44A of housing 34A and thus rotates together with shaft 40A. Conduit 52A in face 44A carries liquid working fluid from the cycle pump to nozzle 54A opening to seal chamber 32A and facing flange 64.

Pressurized cold working fluid liquid from the cycle pump is sprayed into contact with flange 64 producing a spray of fine droplets which are carried by centrifugal force into seal chamber 32A by reason of the rotational speed of the flange. In addition, leakage of vaporized working fluid A through seal 42A encounters the spray of cold liquid as soon as the vaporized working fluid passes through seal 42A so that most of leakage B is cooled before entering seal chamber 32A. This embodiment provides rapid engagement of the hot vapor leaking into seal chamber 32A with cold working fluid, and the rotational movement of flange 64 ensures intimate mixing of the spray of cold liquid with leakage vapors so that the hot vapor is cooled and condensed in seal chamber 32A. Consequently, a liquid containing condensate is produced that drains to vessel 21 and pump 23 supplies this liquid to the exit of condenser 16.

Figure 5:
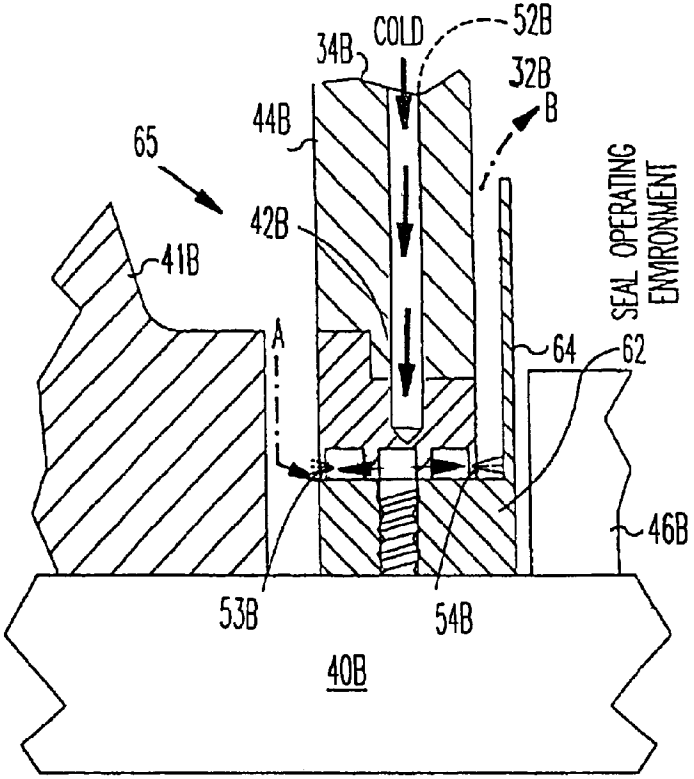
FIG. 5 is a side view of a further modification of the embodiment shown in FIG. 3.

A further embodiment is described with reference to FIG. 5 and numeral 65 designates apparatus For cooling a seal. This embodiment is similar in many respects to the embodiment described with reference to FIG. 4 wherein, in this embodiment, cooled working fluid is injected into chamber 32B via conduit 52B in face 44B carrying liquid working fluid from the cycle pump so that it also impinges on flange or disc 64. However, in this embodiment, cooled working fluid liquid is injected via labyrinth seal 42B into seal chamber 32B at spray 54B as well as delivered in the opposite direction via labyrinth seal 42B to spray 53B so that the leakage of hot, high pressure working via this labyrinth seal is eliminated or at least reduced. Also in this embodiment, liquid containing condensate is produced in seal chamber 32B that drains to vessel 21 and pump 23 supplies this liquid to the exit of condenser 16.

Figure 6:
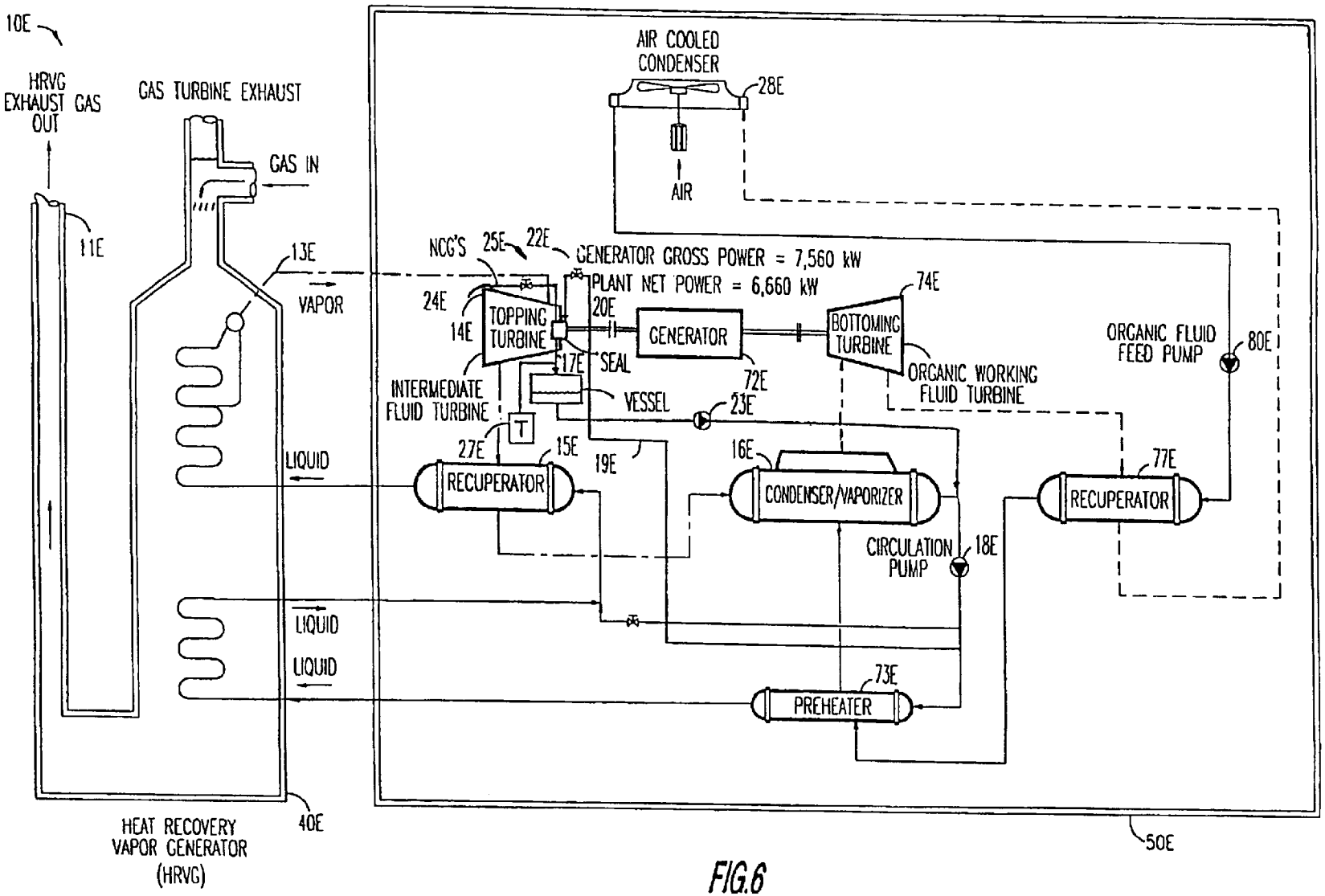
FIG. 6 is a block diagram of an embodiment of the present invention and also shows another power plant into which the present invention is incorporated.

Reference numeral 10E of FIG. 6 designates a further power plant into which the present invention is incorporated, power plant 10E comprising intermediate fluid turbine 14E and organic working fluid turbine 74E. In this arrangement, vapor from heat recovery vapor generator 40E is supplied to the inlet of turbine 14E via line 13E and the exhaust therefrom is supplied to recuperator 15E with the vapors exiting recuperator 21E being supplied to condenser/vaporizer 16E. A more complete description of the operation of this arrangement can be found in U.S. patent application Ser. No. 09/902,802, filed Jul. 12, 2001, the disclosure of which is hereby incorporated by reference. High-pressure seal chamber 20E, associated with intermediate fluid turbine 14E, is supplied with cool condensate from condenser/vaporizer 16E by pump 18E via flow conditioning apparatus 19E. Apparatus 19E serves to properly regulate the flow of condensate liquid working fluid to seal chamber 20E, to isolate the flow of cool condensate to the seal chamber of intermediate turbine 14E, and to allow maintenance to the apparatus without interrupting the operation of the turbines.

In this embodiment, the preferred working fluid used in the intermediate fluid turbine 14E is Therminol LT or Dowtherm J. The working fluid used in organic working fluid turbine 74E and its associated working fluid cycle can be pentane, i.e. n-pentane or iso-pentane, or other suitable hydrocarbons.

Apparatus 19E includes manually operated, variable, flow control valve 22E, a fixed orifice device (not shown), a filter (not shown), and an on/off, or shut-off valve (not shown) serially connected together, and temperature indicator 27E. The size of the fixed orifice, together with the setting of valve 22E, determines the flow rate of cool condensate or liquid working fluid to seal chamber 20E. The filter serves to filter from the condensate supplied to the seal chamber any contaminants whose presence would adversely affect the operation of the seal chamber. The on/off, or shut-off valve is preferably a manually operated ball-valves that can be selectively operated to disconnect the seal chamber from pump 18E when filter replacement or other maintenance operations are necessary allowing the turbine to run for a short time without cooling of the seal chamber and until these maintenance operations are completed. Furthermore, maintenance operations performed when the turbine or power plant is shut down or stopped are simplified by this aspect of the present invention. Finally, the temperature indicators provide an indication of the temperature of the fluid exhausted from seal chamber 20E.

Valve 22E is manually operated, preferably in accordance with the temperature of the fluid in line 17E. That is to say, the amount of cooling condensate applied to seal chamber 20E can be adjusted by an operator by changing the setting of valve 22E in response to the temperature indicated by the temperature indicator. Optionally, temperature sensors or transducers that produce control signals in accordance with the temperature of the cooling liquid leaving the seal chamber can replace the temperature indicators. In such case, valve 22E could be replaced with a valve that is responsive to such control signals for maintaining the proper flow rate of cooling liquid to seal chamber 20E.

While the embodiments described above refer to a chamber as a form of the operating seal environment, any suitable enclosure may be used.

Furthermore, while the above description refers to the working fluid as a organic working fluid, the present invention can also be used with connection to steam such as in a steam turbine system using for example a gland condenser. For example, cool steam condensate can be pumped from the cycle pump to the seal of the steam turbine chamber via a conduit or line in order to cool and condense by directly contacting the high-pressure steam leaking across the seal. According to the present invention, a further conduit or line can be provided for collecting the liquid water from the seal and supply it to an accumulation vessel and thereafter to the cycle pump.

In addition, when an organic working fluid is used as the working fluid in the Rankine cycle power plant such as the one described with reference to FIGS. 1 and 6 in the intermediate fluid turbine 14E and its associated working fluid cycle (as well as the working fluids used in the embodiments described with reference to FIGS. 2, 3, 4 and 5) the working fluid is preferably chosen from the group bicyclic aromatic hydrocarbons, substituted bicyclic aromatic hydrocarbons, heterocyclic aromatic hydrocarbons, substituted heterocyclic aromatic hydrocarbons, bicyclic or heterobicyclic compounds where one ring is aromatic and the other condensed ring is non-aromatic, and Their mixtures such as napthalene, 1-methyl-napthalene, 1-methyl-napthalene, tetralin, quinolene, benzothiophene; an organic, alkylated heat transfer fluid or a synthetic alkylated aromatic heat transfer fluid, e.g. thermal oils such as Therminol LT fluid (an alkyl substituted aromatic fluid), Dowtherm J (a mixture of isomers of an alkylated aromatic fluid), isomers of diethyl benzene and mixtures of the isomers and butyl benzene; and nonane, n-nonane, iso-nonane, or other isomers and their mixtures. The most preferred working fluid used is an organic, alkylated heat transfer fluid or a synthetic alkylated aromatic heat transfer fluid, e.g. thermal oils such as Therminol LT fluid (an alkyl substituted aromatic fluid), Dowtherm J (a mixture of isomers of an alkylated aromatic fluid), isomers of diethyl benzene and mixtures of the isomers and butyl benzene.

The advantages and improved results furnished by the method and apparatus of the present invention are apparent from the foregoing description of the preferred embodiment of the invention. Various changes and modifications may be made without departing from the spirit and scope of the invention as described in the appended claims.

What is claimed is:

1. A method for cooling a seal located in a wall of a seal chamber and through which a movable shaft passes, said seal being heated by hot pressurized vapor that leaks through a labyrinth into the seal chamber and internal friction, said method comprising the steps of: (a) providing a seal chamber in which the seal is located and into which said hot pressurized vapor leaks; (b) injecting cool liquid into the seal chamber in which the seal is located; (c) cooling and condensing said hot pressurized vapor in said seal chamber thus cooling the seal and reducing the pressure in the seal chamber and producing condensate; (d) supplying liquid containing said condensate from said seal chamber to a seal chamber condensate drainage vessel for collecting only liquid containing said condensate produced in said seal chamber; and (e) pumping liquid containing the collected condensate from said seal chamber condensate drainage vessel to an exit of a condenser.

2. A method according to claim 1 comprising the step of providing a pressure chamber for containing the hot pressurized vapor within which a turbine wheel is mounted on said shaft, and vapor leaks past said labyrinth mounted on the shaft between the turbine wheel and the seal.

3. A method according to claim 2 comprising the step of adding the liquid to the chamber in which the seal is located by injecting the liquid into said chamber near a disc mounted in the chamber, said disc being mounted on, and rotatable with, said shaft.

4. A method according to claim 1 for use in a power plant that includes a vaporizer for vaporizing a working fluid, a turbine mounted on said shaft for expanding the working fluid, a condenser for condensing expanded working fluid, and a cycle pump for returning condensate from the condenser to the vaporizer, and comprising the step of supplying the liquid exiting said chamber in which the seal is located via a vessel to a line exiting said condenser and connected to said cycle pump.

5. A method according to claim 4 comprising the step of adding the liquid to th chamber in which the seal is located from output of the cycle pump.

6. Apparatus for cooling a seal located in a wall of a seal chamber and through which a movable shaft passes, said seal being heated by hot pressurized vapor that leaks through the seal into the seal chamber and internal friction, said apparatus comprising: (a) a seal chamber in which the seal is located and into which leaks the hot pressurized vapor; (b) means for injecting liquid into the seal chamber in which the seal is located such that the hot pressurized vapor is cooled and condenses in said seal chamber, thus cooling the seal and producing condensate; (c) a line that supplies liquid containing said condensate from said seal chamber to a seal chamber condensate drainage vessel for collecting only liquid containing said condensate produced in said seal chamber; and (d) a pump that supplies liquid containing the collected condensate from said seal chamber condensate drainage vessel to an exit of a condenser.

7. Apparatus according to claim 6 comprising a turbine wheel mounted on said shaft in a pressure chamber containing hot pressurized, vaporized working fluid, wherein said shaft passes through a labyrinth seal mounted on the shaft.

8. Apparatus according to claim 7 comprising means for adding the liquid to the chamber in which the seal is located near a disc in the chamber mounted on the shaft and rotatable therewith.

9. Apparatus according to claim 6 further comprising a vaporizer for vaporizing a working fluid, a turbine mounted on said shaft for expanding the working fluid, a condenser for condensing expanded working fluid, a cycle pump for returning condensate from the condenser to the vaporizer and means for supplying the liquid exiting said chamber in which the seal is located via a vessel to a line exiting said condenser and connected to said cycle pump.

10. Apparatus according to claim 9 comprising supplying means for supplying the liquid from the output of said cycle pump to said chamber in which the seal is located via said means for injecting liquid into the chamber.

11. Apparatus according to claim 9 wherein said working fluid comprises an organic working fluid.

12. Apparatus according to claim 9 wherein said working fluid comprises an alkyl substituted aromatic fluid.

* * * * *